United States Patent [19]

Rubin

[11] Patent Number: 4,742,688

[45] Date of Patent: May 10, 1988

[54] LEVEL INDICATOR FOR CARBON DIOXIDE SNOW IN A COLD BOX

[76] Inventor: Julius Rubin, 54 Madison Ave., Franklin Square, N.Y. 11010

[21] Appl. No.: 22,121

[22] Filed: Mar. 5, 1987

[51] Int. Cl.[4] ..... F25B 49/00

[52] U.S. Cl. ..... 62/125; 116/227

[58] Field of Search ..... 62/125; 116/227; 73/290 R, 298; 340/617, 624; 414/289

[56] References Cited

U.S. PATENT DOCUMENTS

| | | | |
|---|---|---|---|
| 1,661,995 | 3/1928 | Brown | 116/227 X |
| 1,744,064 | 1/1930 | Zagarino et al. | 340/624 |
| 2,057,034 | 10/1936 | Kinney, Jr. | 73/290 R |
| 2,098,963 | 11/1937 | Hexter | 73/290 R X |
| 2,907,844 | 10/1959 | Lindsey | 340/624 X |
| 3,561,226 | 2/1971 | Rubin | 62/388 X |
| 4,286,439 | 9/1981 | Pasternack | 62/125 X |
| 4,426,851 | 1/1984 | Neumann | 340/617 X |

FOREIGN PATENT DOCUMENTS

| | | | |
|---|---|---|---|
| 1127098 | 5/1955 | France | 116/227 |

*Primary Examiner*—William E. Tapolcai
*Attorney, Agent, or Firm*—Paul W. Garbo

[57] ABSTRACT

A device for indicating the level of carbon dioxide snow in the cold box of a refrigerated vehicle comprises three basic elements: a shaft, a disk mounted on an end of the shaft and a bearing to hold the shaft. The bearing is positioned so that the shaft extends vertically through the bottom of the cold box. The disk on the shaft moves up or down within the box by pushing or pulling the bottom end of the shaft. The distance that the shaft is pulled down at time intervals after the box is filled with carbon dioxide snow while the disk was against the top of the box indicates how much the snow level has fallen because of carbon dioxide sublimitation.

10 Claims, 1 Drawing Sheet

LEVEL INDICATOR FOR CARBON DIOXIDE SNOW IN A COLD BOX

BACKGROUND OF THE INVENTION

This invention relates to means for determining the amount of solid carbon dioxide ($CO_2$) in a container used as the source of refrigeration in trucks, trailers, rail cars and like chambers in which perishable products such as frozen foods are transported.

U.S. Pat. No. 3,561,226 to Julius Rubin discloses such a refrigeration system based on a container which is filled with $CO_2$ snow and is mounted under the roof of the truck or rail car. This refrigeration system has found favor particularly in the railroad shipment of food products.

Often an appreciable potion of the $CO_2$ snow charged into the container, also referred to as the cold box, for a particular trip lasting several days will remain in the cold box after the rail car has reached the delivery depot and has been emptied of the goods it transported. Hence, the rail car is ready to be loaded again with perishable products for shipment to another destination. However, no simple and satisfactory way has heretobefore been devised for estimating the amount of $CO_2$ snow still in the cold box after the last delivery. Perhaps, there is enough $CO_2$ snow for the next three-day trip that charging the cold box with more $CO_2$ snow is unnecessary and wasteful. However, there is the danger that the residual $CO_2$ snow will suffice for only a day. Hence, in the absence of a reasonable estimate of the $CO_2$ snow still in the cold box, it is common practice to be overcautious by charging additional $CO_2$ snow into the cold box until it is full each time the rail car is to be reloaded with goods requiring refrigeration during the next shipment. This is obviously a wasteful practice.

A principal object of this invention is to provide simple means for estimating the amount of $CO_2$ snow in a container or cold box of a refrigeration system of the type disclosed in U.S. Pat. No. 3,561,226.

SUMMARY OF THE INVENTION

In accordance with this invention, the means for estimating the depth or amount of $CO_2$ snow in a cold box comprises a shaft extending vertically through a bearing disposed at the bottom wall of the cold box and a disk attached to the top end of the shaft within the cold box. The shaft is normal to the disk and has a length greater than the depth of the cold box so that the bottom end of the shaft at all positions of the disk within the cold box always projects outwardly from the bottom wall of the cold box.

The bottom end of the shaft outside the cold box is preferably provided with spring means to push the disk upward to the top wall of the cold box or with locking means to hold the disk at the top wall after the shaft has been pushed up manually.

The shaft, bearing and disk of the device of this invention can be made of any metal or other material that can withstand the low temperature of −110° F. of solid $CO_2$ at atmospheric pressure. Stainless steel is usually selected for the shaft and bearing while a glass fiber-plastic composite is often chosen for the disk which is generally circular but may have any shape such as oval, square or hexagonal.

BRIEF DESCRIPTION OF THE DRAWINGS

To facilitate the further description and understanding of the invention, reference will be made to the accompanying drawings of which.

DESCRIPTION OF PREFERRED EMBODIMENTS

Figure 1:
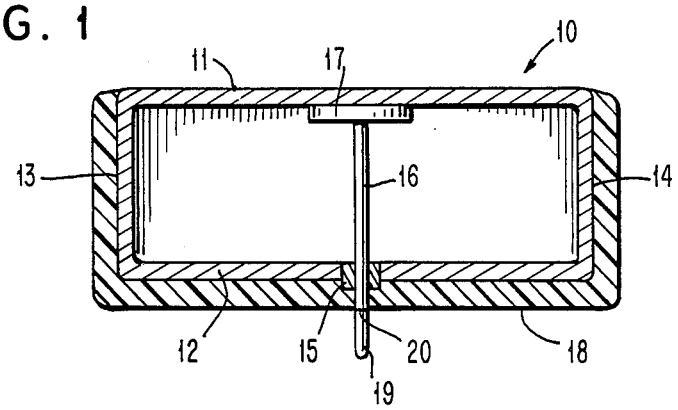
FIG. 1 is a transverse cross-sectional view of a cold box of the type shown in FIG. 2 of U.S. Pat. No. 3,561,226 which was constructed to embody the device of this invention for determining the level of $CO_2$ snow therein at any desired time.

FIG. 1 is a transverse cross-section of elongate cold box 10. Before top wall 11 and bottom wall 12 were united with, and sealed to, side walls 13,14, bearing 15 holding shaft 16 with disk 17 mounted on the top end thereof was fastened in a hole in bottomwall 12. Walls 11,12,13,14 may be sheet metal such as aluminum or stainless steel or may be formed of plastic reinforced with glass fibers. Bearing 15, shaft 16 and disk 17 are usually made of aluminum or stainless steel. Generally, shaft 16 will not exceed about 0.5 inch in diameter while disk 17 will have a diameter of approximately 6 to 12 inches. Stated broadly to cover all disk shapes, such as circular, oval, square etc., disk 17 should preferably have a bottom face area of about 30 to 120 square inches.

Inasmuch as $CO_2$ snow has a temperature of −110° F. at atmospheric pressure, cold box 10 will in most cases have insulation 18 applied to the exposed surfaces of walls 12,13,14 so that the temperature at the outer surface of insulation 18 is about −10° F. or 0° F. Polyurethane foam in a thickness of about 2 inches is a desirable type of insulation 18. Top wall 11 is shown without insulation 18 because cold box 10 is fastened against the insulated ceiling (not shown) of a rail car or truck.

Shaft 16 is shown in FIG. 1 in the fully pushed up position so that disk 17 is against top wall 11. Liquid $CO_2$ at a pressure of about 300 pounds per square inch absolute and temperature of 0° F. is sprayed into cold box 10 to form $CO_2$ snow as taught in U.S. Pat. No. 3,561,226 while disk 17 is against top wall 11. When cold box 10 is believed to have been filled with $CO_2$ snow, bottom end 19 of shaft 16 is pulled downward. If shaft 16 cannot be moved downward, this indicates that box 10 is full of $CO_2$ snow and the rail or truck in which cold box 10 is installed is ready for making a shipment of frozen food or other goods requiring refrigeration. When the shipment has been completed and before the rail car or truck is again loaded with goods, shaft end 19 is pulled to determine how far disk 17 will move down. Circular groove or mark 20 on shaft 16 is aligned with the exterior surface of insulation 18 at the bottom of cold box 10 when disk 17 is against top wall 11. The depth of cold box 10, usually in the range of 6 to 10 inches, is known in each case.

Assuming a rail car in which cold box 10 has a depth of 8 inches has delivered frozen food and shaft end 19 can be pulled down so that mark 20 on shaft 16 moves about 3.8 inches down from the experior surface of insulation 18 at the bottom of box 10, it becomes evident that box 10 is still approximately half full of $CO_2$ snow. Obviously, as the level of $CO_2$ snow in box 10 drops so also will disk 17 which contacts the upper surface of the $CO_2$ snow layer in box 10. When all the $CO_2$ snow has vanished, shaft end 19 can be pulled until disk 17 rests on bottom wall 12; in such position, mark 20 on shaft 16 will be 8 inches below the bottom surface of insulation 18 on cold box 10.

Generally, a single shaft 16 with disk 17 positioned at about the midpoint in the length of cold box 10 will suffice if box 10 is less than 20 feet long. For large cold boxes such as installed in rail cars, it is advisable to provide several devices of this invention in each box. For example, a cold box that is 40 feet long may be equipped with three depth-probing devices equally spaced from one another. Clearly, a plurality of the devices of this invention in a large cold box will afford the opportunity to get a more reliable, average estimate of the quantity of $CO_2$ snow therein than is possible with a single device.

Figure 2:
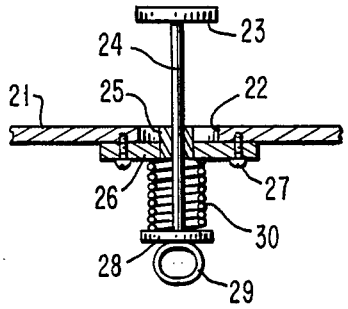
FIG. 2 is a partial cross-sectional view of the bottom wall of an existing cold box of the type shown in U.S. Pat. No. 3,561,226 to which the novel level measuring device has been subsequently added.

FIG. 2 shows the bottom wall 21 of an existing cold box to which the novel device was added. A hole 22 was cut in wall 21 large enough to pass disk 23 on shaft 24 therethrough. Shaft 24 is held in bearing 25 which is mounted in plate 26. Screws 27 fasten plate 26 to bottom wall 21 so that $CO_2$ snow will not fall out of hole 22. The bottom end of shaft 24 has disk 28 and knob 29 attached thereto. Tension coil spring 30 has its upper end welded or otherwise fastened to plate 26 and its lower end welded to disk 28. In its fully contracted state, spring 30 holds disk 23 against the top wall (not shown) of the cold box. By pulling knob 29 downward any stretch of spring 30 will indicate that disk 23 has moved down and, therefore, that the cold box is not completely filled with $CO_2$ snow. When disk 23 has been pulled down so that it hits bearing 25, disk 28 will have moved away from plate 26 a distance equal to the depth of the cold box; this will clearly indicate that there is no $CO_2$ snow in the cold box.

Figure 3:
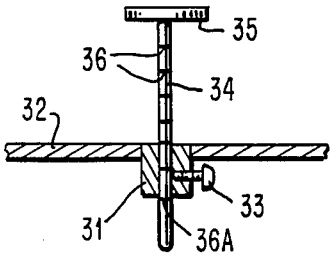
FIG. 3 is a partial cross-sectional view of the bottom wall of a cold box similar to that of FIG. 1 showing variations of the bearing and shaft of the device of the invention.

FIG. 3 shows a variation of bearing 15 and shaft 16 of FIG. 1. Bearing 31 in bottom wall 32 of a cold box has wing-head screw 33 extending radially therethrough so that screw 33 can contact shaft 34 which holds disk 35 on its top end. Tightening screw 33 keeps shaft 34 from moving regardless of vibration of the rail car or truck in which it is installed. A plurality of equally spaced marks or grooves 36 on shaft 34 provide an easy way of estimating the depth of $CO_2$ snow in the cold box. For example, the lowest groove 36A when aligned with the bottom end of bearing 31 serves as the starting reference point for a load of $CO_2$ snow that completely fills the box. If grooves 36 are one inch apart, each groove 36 which becomes visible below bearing 31 indicates that the level of $CO_2$ snow in the cold box has dropped another inch.

Modifications and variations of the novel device of this invention will be apparent to those skilled in the art without departing from the spirit and scope of the invention. For instance, many detents or means for holding or locking a shaft in a desired position are known substitutes for screw 33 in FIG. 3. A series of spaced numerals e.g., 1,2,3 etc., may replace markings 36 on shaft 34 which may be made of Teflon* or other plastic. The bottom end of shaft 34 may have a diametrical hole with a ring handle that swivels therein. In FIG. 2, spring 30 may be replaced with a detent, and disk 28 with knob 29 may be omitted or replaced by a swivel ring handle. In FIG. 1, shaft end 19 below groove 20 may be a chain or other flexible handle. Accordingly, only such limitations should be imposed on the invention as are set forth in the appended claims.

*Trademark for polytetrafluoroethylene

What is claimed is:

1. A device for indicating the level of $CO_2$ snow in a cold box that is used to provide refrigeration and is mounted along the ceiling of a vehicle used for the transportation of goods requiring refrigeration, which comprises a shaft extending vertically through a bearing disposed at the bottom wall of said cold box, and a disk attached to the top end of said shaft within said cold box, said shaft being normal to said disk and having a length greater than the depth of said cold box so that the bottom end of said shaft at all times projects outwardly from said bottom wall of said cold box.

2. The device of claim 1 wherein the bottom end of the shaft outside the cold box is provided with spring means to push the disk upward to the top wall of said cold box.

3. The device of claim 2 wherein the bottom end of the shaft outside the cold box is provided with a handle for pulling said shaft downward.

4. The device of claim 1 wherein the shaft has a series of markings equally spaced along the length thereof to serve as a measuring scale of the distance that the disk attached to said shaft can be moved down.

5. The device of claim 4 wherein the shaft is provided with locking means for holding said shaft at any desired position.

6. The device of claim 1 wherein the shaft is provided with locking means for holding said shaft at any desired position.

7. The device of claim 1 wherein the bearing disposed at the bottom wall of the cold box is set in a plate fastened to said bottom wall to seal an opening in said bottom wall, said opening being large enough for the insertion of the disk on the top end of the shaft into said cold box.

8. The device of claim 7 wherein the bottom end of the shaft extending below the plate is provided with spring means to push the disk on the top end of said shaft upward to the top wall of the cold box.

9. The device of claim 8 wherein the bottom end of the shaft has a handle for pulling said shaft downward.

10. The device of claim 1 wherein the shaft has a diameter not exceeding about 0.5 inch and the disk has a bottom face area in the range of about 30 to 120 square inches.

* * * * *